US009056498B2

(12) United States Patent
Maeyama et al.

(10) Patent No.: US 9,056,498 B2
(45) Date of Patent: Jun. 16, 2015

(54) IMAGE FORMING APPARATUS INCLUDING SHEET CUTTING DEVICE

(75) Inventors: Yuichiro Maeyama, Kanagawa (JP); Toshihiro Yoshinuma, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 426 days.

(21) Appl. No.: 13/621,218

(22) Filed: Sep. 15, 2012

(65) Prior Publication Data

US 2013/0095990 A1 Apr. 18, 2013

(30) Foreign Application Priority Data

Oct. 12, 2011 (JP) ..... 2011-225093

(51) Int. Cl.

| | |
|---|---|
| ***B41J 2/165*** | (2006.01) |
| ***B41J 11/00*** | (2006.01) |
| ***B41J 11/70*** | (2006.01) |
| ***B26D 1/18*** | (2006.01) |
| ***B26D 1/24*** | (2006.01) |
| *B26D 7/00* | (2006.01) |

(52) U.S. Cl.

CPC ..... *B41J 11/006* (2013.01); *B41J 11/706* (2013.01); *B26D 1/185* (2013.01); *B26D 1/245* (2013.01); *B26D 2007/005* (2013.01)

(58) Field of Classification Search

None

See application file for complete search history.

(56) References Cited

U.S. PATENT DOCUMENTS

| | | | |
|---|---|---|---|
| 5,613,415 | A | 3/1997 | Sanpei |
| 5,881,623 | A | 3/1999 | Otani et al. |
| 6,721,060 | B1 | 4/2004 | Kawamura et al. |
| 8,016,502 | B2 | 9/2011 | Akatsu et al. |
| 8,459,887 | B2 | 6/2013 | Yamashita et al. |
| 8,678,690 | B2 | 3/2014 | Yamashita et al. |
| 2009/0226236 | A1 | 9/2009 | Yamashita et al. |
| 2010/0066781 | A1 | 3/2010 | Niihara et al. |
| 2011/0057380 | A1 | 3/2011 | Maeyama et al. |
| 2011/0063644 | A1 | 3/2011 | Niihara et al. |
| 2011/0064497 | A1 | 3/2011 | Niihara et al. |
| 2011/0103870 | A1 | 5/2011 | Ikeda et al. |

(Continued)

FOREIGN PATENT DOCUMENTS

| | | |
|---|---|---|
| CN | 1168829 | 12/1997 |
| CN | 101497281 | 8/2009 |

(Continued)

OTHER PUBLICATIONS

Chinese Office Action dated Jul. 24, 2014 in corresponding.

(Continued)

*Primary Examiner* — Alejandro Valencia

(74) *Attorney, Agent, or Firm* — Cooper & Dunham LLP

(57) ABSTRACT

An image forming apparatus includes a recording head, a carnage, a sheet cutting device, a cutter position detecting device, and a controller. The cutting device includes a cutter and a cutter unit holding the cutter. A movement area of the carriage overlaps a movement area of the cutter unit in a thickness direction of a sheet. The detecting device detects a position of the cutter unit. The controller performs initial operation upon power on of the apparatus to move the cutter unit to a cutter home position located at one end of the movement area of the cutter unit. The cutter unit, after cutting the sheet, is movable in a width direction of the sheet with the cutter unit retracted from a sheet feed path in the thickness direction. The controller determines whether or not to perform the initial operation based on detection results of the detecting device.

10 Claims, 17 Drawing Sheets

(56) References Cited

U.S. PATENT DOCUMENTS

| | | | |
|---|---|---|---|
| 2011/0211210 | A1 | 9/2011 | Niihara et al. |
| 2011/0229242 | A1 | 9/2011 | Morinaga et al. |
| 2012/0139987 | A1 | 6/2012 | Maeyama et al. |
| 2012/0140010 | A1 | 6/2012 | Ogawa et al. |
| 2012/0140011 | A1 | 6/2012 | Yamada et al. |
| 2012/0210838 | A1 | 8/2012 | Maeyama et al. |
| 2014/0139600 | A1 | 5/2014 | Yamashita et al. |

FOREIGN PATENT DOCUMENTS

| | | | |
|---|---|---|---|
| CN | 101524847 | | 9/2009 |
| EP | 0960740 | A1 | 12/1999 |
| JP | 2000-271897 | | 10/2000 |
| JP | 2001-88383 | | 4/2001 |
| JP | 2006-137070 | | 6/2006 |
| JP | 2009-214200 | | 9/2009 |
| JP | 2012-115952 | | 6/2012 |
| JP | 2012-171105 | | 9/2012 |

OTHER PUBLICATIONS

Chinese patent application No. 2012 10 38 2525.7.
U.S. Appl. No. 13/366,466, filed Feb. 6, 2012, Masato Ogawa, et al.
U.S. Appl. No. 13/366,427, filed Feb. 6, 2012, Toshihiro Yoshinuma, et al.
U.S. Appl. No. 13/402,238, filed Feb. 22, 2012, Masahiko Yamada, et al.
European Search Report dated Feb. 22, 2013 in corresponding.
European patent application No. 12 18 5060.6.

IMAGE FORMING APPARATUS INCLUDING SHEET CUTTING DEVICE

CROSS-REFERENCE TO RELATED APPLICATION

This patent application is based on and claims priority pursuant to 35 U.S.C. §119 to Japanese Patent Application No. 2011-225093, filed on Oct. 12, 2011 in the Japan Patent Office, the entire disclosure of which is hereby incorporated by reference herein.

BACKGROUND

1. Technical Field

This disclosure relates to an image forming apparatus, and more specifically to an image forming apparatus including a sheet cutting device to cut a rolled sheet to a desired length.

2. Description of the Related Art

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet. The image forming apparatus typically has a sheet cutting device to cut the rolled sheet to a desired length by moving a cutter in a direction perpendicular to the sheet feed direction (hereinafter, width direction).

Such a conventional sheet cutting device needs to return a cutter unit holding the cutter to an initial position (home position) in preparation for the next sheet cutting. At this time, if a forward path along which the cutter moves to cut the sheet is identical to a backward path along which the cutter moves to return to the home position, the cutter might contact an already-cut sheet on the backward path, thus hampering movement of the cutter unit (so-called "cut jam") or causing other failure.

To prevent such a cut jam or other failure, for example, JP-2009-214200-A proposes an image forming apparatus including a sheet cutting device in which the backward path of the cutter formed with a pair of circular blades differs from the forward path of the cutter. Relative to the forward path, the backward path is arranged at a downstream side in the sheet feed direction in which the sheet is fed along a sheet feed path and at a position away from a leading edge of a subsequent divided sheet upstream from the cutter in the sheet feed direction.

However, in the image forming apparatus described in JP-2009-214200-A, the cutter unit and the carriage holding the recording head are arranged independently of each other and in tandem in the sheet feed direction, thus resulting in an increased width of the image forming apparatus in the sheet feed direction. As described above, in the image forming apparatus, the forward path of the cutter differs from the backward path, thus preventing the cutter from contacting the subsequent divided sheet on the backward path. However, the cutter unit still remains on the sheet feed path after cutting operation. As a result, the subsequent sheet cannot be fed from the rolled sheet until the cutter and the cutter unit return to the home position, thus hampering gains in productivity.

Hence, in JP-2010-268563 (JP-2012-115952-A), the applicant of the present application proposed a sheet cutting device capable of dealing with such a challenge and an image forming apparatus including the sheet cutting device. In the image forming apparatus, the carriage is arranged to overlap the cutter unit in a thickness direction of a rolled sheet to reduce the width of an apparatus body in the sheet feed direction. Additionally, relative to the forward path, the backward path is arranged so as to be retracted from the sheet feed path in the thickness direction of the rolled sheet. Thus, after the cutting of the rolled sheet, the cutter unit is movable along the backward path with the cutter unit retracted from the sheet feed path.

However, in the image forming apparatus having such a configuration, because the carriage is arranged to overlap the cutter unit in the thickness direction of the sheet, a movement area of the carriage in the sheet width direction (the main scanning direction) overlaps a movement area of the cutter unit along the forward path. As a result, if the cutter unit moves when the carriage is placed on the movement area or the carriage moves when the cutter unit is placed on the movement area, the carriage and the cutter unit would interfere with each other.

For the image forming apparatus, for example, when the cutter unit and/or the carriage are not placed at the corresponding home positions, initial operation is performed to return (move) the cutter unit and the carriage to the respective home positions. For the initial operation, it is necessary to prevent the carriage and the cutter unit from contacting each other when the cutter unit and/or the carriage are/is returned to the home positions.

BRIEF SUMMARY

In an aspect of this disclosure, there is provided an image forming apparatus including a recording head, a carriage, a sheet cutting device, a cutter position detecting device, and a controller. The recording head ejects liquid onto a sheet of recording media fed along a sheet feed path. The carriage mounts the recording head and reciprocally movable in a width direction of the sheet to record an image on the sheet on the sheet feed path with the recording head. The width direction of the sheet is perpendicular to a sheet feed direction in which the sheet is fed along the sheet feed path. The sheet cutting device includes a cutter to cut the sheet to a desired length and a cutter unit holding the cutter. The cutter unit is movable in the width direction of the sheet. A movement area of the carriage overlaps, in a thickness direction of the sheet, a movement area of the cutter unit in which the cutter unit moves to cut the sheet with the cutter. The cutter position detecting device detects a position of the cutter unit. The controller performs initial operation upon power on of the image forming apparatus to move the cutter unit to a cutter home position located at one end of opposed ends of the movement area of the cutter unit. The cutter unit, after cutting the sheet with the cutter, is movable in the width direction of the sheet with the cutter unit retracted from the sheet feed path in the thickness direction of the sheet. The controller determines whether or not to perform the initial operation based on detection results of the cutter position detecting device.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 14 is a flow chart of a process of cutter initial operation performed by a controller when the inkjet recording apparatus according to the first exemplary embodiment is powered on;

FIG. 18 is a flow chart of a process of cutter initial operation performed by a controller when the inkjet recording apparatus according to the second exemplary embodiment is powered on;

FIG. 21 is a flow chart of a process of cutter initial operation performed by a controller when the inkjet recording apparatus according to the third exemplary embodiment is powered on.

Figure 1:
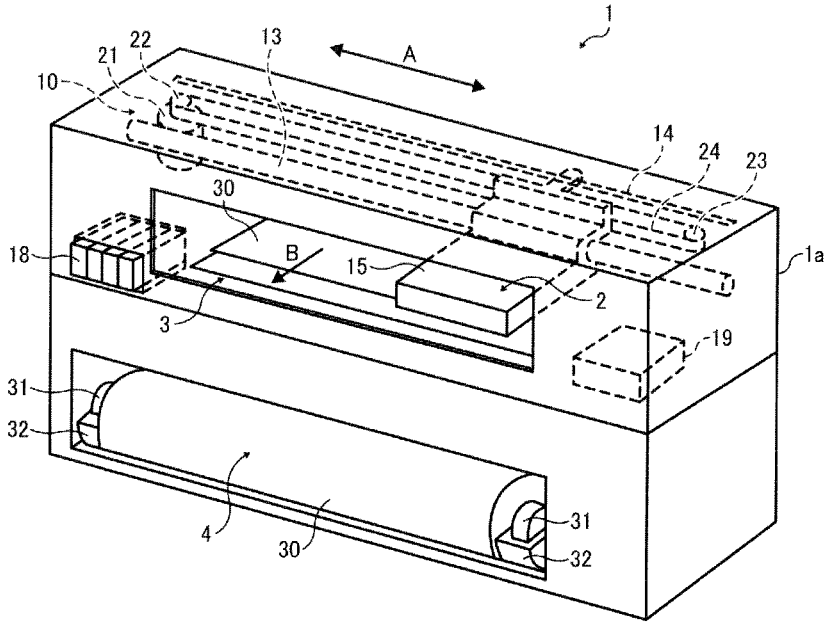
FIG. 1 is a schematic perspective view of an inkjet recording apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First Exemplary Embodiment

FIGS. 1 to 14 show an image forming apparatus according to a first exemplary embodiment of the present disclosure.

In FIGS. 1 to 14, an inkjet recording apparatus is illustrated as an example of the image forming apparatus.

Figure 2:
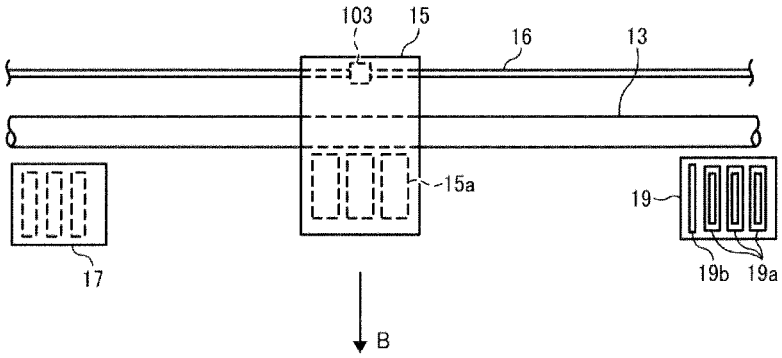
FIG. 2 is a schematic plan view of a carriage illustrated in FIG. 1.
Figure 3:
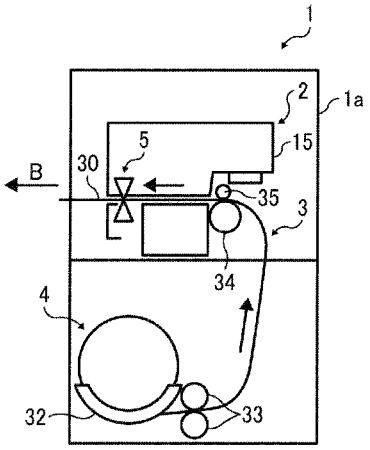
FIG. 3 is a schematic side view of the inkjet recording apparatus illustrated in FIG. 1.

In FIGS. 1 to 3, an inkjet recording apparatus 1 serving as the image forming apparatus is a serial-type inkjet recording apparatus that moves an inkjet recording head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image.

Figure 12:
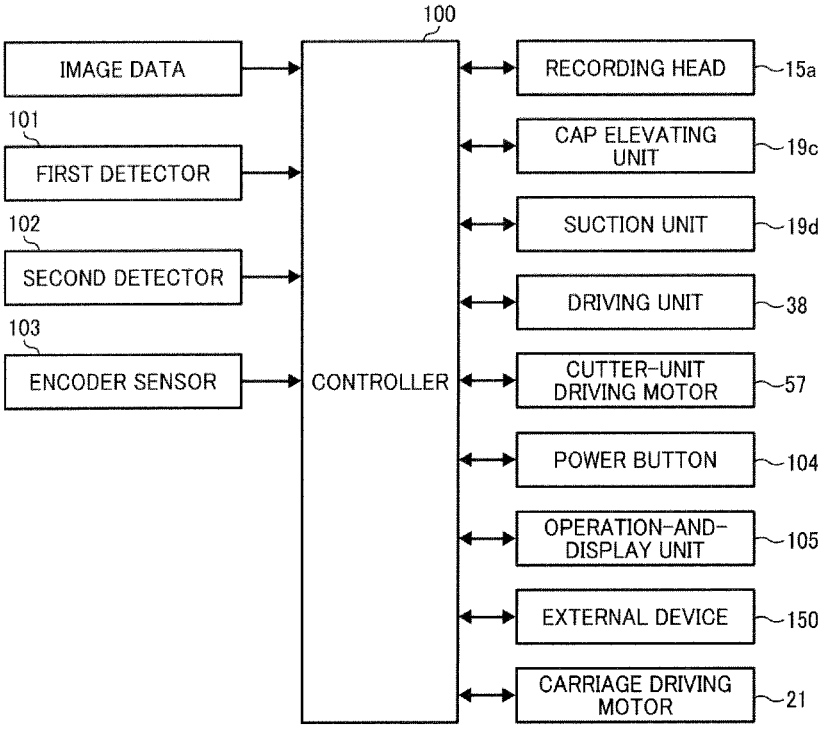
FIG. 12 is a schematic block diagram of a control configuration of the inkjet recording apparatus according to the first exemplary embodiment.

The inkjet recording apparatus 1 includes an image forming section 2 serving as an image forming device, a sheet feed section 3, a rolled sheet storage section 4, a sheet cutting device 5, and a controller 100 (see FIG. 12). The image forming section 2, the sheet feed section 3, the rolled sheet storage section 4, the sheet cutting device 5, and the controller 100 are disposed within an apparatus body 1*a*.

In the image forming section 2, a guide rod 13 and a guide rail 14 extend between side plates, and a carriage 15 is supported by the guide rod 13 and the guide rail 14 so as to be able to slide in a direction indicated by an arrow A in FIG. 1. The term "slide" used herein means that the carriage 15 moves on the guide rod 13 and the guide rail 14 along a direction indicated by an arrow A while contacting the guide rod 13 and the guide rail 14.

The carriage 15 holds recording heads 15*a* (see FIG. 2) to eject ink droplets of, e.g., black (K), yellow (Y), magenta (M), and cyan (C). Sub tanks are integrally molded with the corresponding recording heads 15*a* to supply color inks to the respective recording heads 15*a*.

Figure 13:
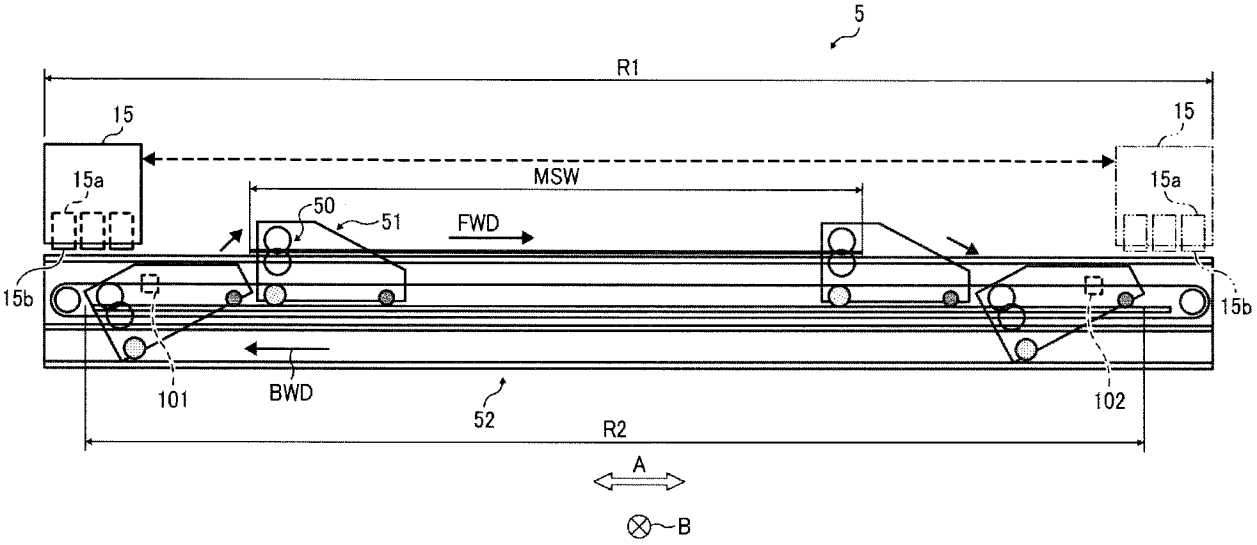
FIG. 13 is a schematic view of movement ranges of the carriage and the cutter unit.

A main scanning mechanism 10 moves the carriage 15 for scanning in a main scanning direction, that is, the sheet width direction indicated by the arrow A in FIG. 1. Specifically, as illustrated in FIG. 13, the carriage 15 is movable in the sheet width direction between a carriage home position (indicated by a solid line in FIG. 13) and a dummy ejection position (indicated by a broken line in FIG. 13). The carriage home position and the dummy ejection position of the carriage 15 are disposed away from each other in the sheet width direction outside a range of a maximum sheet width MSW. Hereinafter, the movement range of the carriage 15 in the sheet width direction (indicated by an arrow R1 in FIG. 13) may be referred to as "carriage movement range". In other words, the dummy ejection position and the carriage home position are located at both ends of the carriage movement range R1. The dummy ejection position and the carriage home position are located at retreat positions outside an area (cutter unit movement range) in which a cutter unit 51 moves, thus preventing the carriage 15 from contacting the cutter unit 51. The dummy ejection position and the carriage home position are collectively referred to as cutting standby positions. In this exemplary embodiment, the carriage home position corresponds to a first standby position, and the dummy ejection position corresponds to a second standby position.

As illustrated in FIG. 1, the main scanning mechanism 10 includes a carriage driving motor 21 disposed at a first end in the sheet width direction, a driving pulley 22 rotated by the carriage driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, as illustrated in FIG. 2, an encoder sheet 16 is disposed along the sheet width direction in which the carnage 15 moves. An encoder sensor 103 disposed at the carriage 15 reads the encoder sheet 16 to detect the main scanning position of the carriage 15.

As illustrated in FIGS. 1 and 2, in a recording area of a main scanning region (movement range R1) of the carriage 15, a rolled sheet 30 is intermittently fed by the sheet feed section 3 in a direction perpendicular to the sheet width direction, that is, the sheet feed direction indicated by an arrow B in FIGS. 1 and 2.

Outside the movement range R1 of the carriage 15 in the sheet width direction or at a side proximal to a first end of the main scanning region of the carriage 15, main cartridges 18 are removably mounted to the apparatus body 1*a* to store the respective color inks to be supplied to the sub tanks of the recording heads 15*a*. Additionally, as illustrated in FIG. 2, at a first side proximal to the dummy ejection position of the carriage movement range R1 (left side in FIG. 2), a dummy ejection receptacle 17 is disposed to store ink droplets ejected in dummy ejection in which ink droplets not contributing to image recording are ejected to remove viscosity-increased ink. Under certain conditions, the recording heads 15*a* perform the dummy ejection at the dummy ejection position to maintain and recover desired ejection performance.

At a second side proximal to the carriage home position of the carriage movement range R1 (right side in FIG. 2), a capping position is located at which a maintenance unit (maintenance-and-recovery unit) 19 is disposed to maintain and recover conditions of the recording heads 15*a*. The maintenance unit 19 includes, e.g., caps 19*a* to cap respective nozzle faces 15*b* (see FIG. 4) of the recording heads 15, a wiper blade 19*b* serving as a blade member to wipe the nozzle faces 15*b*, a cap elevating unit 19*c* (see FIG. 12) to move the caps 19*a* and the wiper blade 19*b* up and down, and suction units 19*d* (see FIG. 12) connected to the caps 19*a* to suction the nozzle faces 15*b* with the nozzle faces 15*b* capped with the caps 19*a*.

For example, after printing operation is finished or when the power of the inkjet recording apparatus 1 is turned on (hereinafter may he simply referred to as "when the power is turned on"), the cap elevating unit 19*c* is driven to cap the nozzle faces 15*b* with the caps 19*a*. When the suction units 19*d* are activated with the nozzle faces 15*b* capped with the caps 19*a*, the internal space of each of the caps 19*a* is turned to a negative pressure, thus allowing ink to be discharged from the nozzles into the caps 19*a*. The discharged waste ink is drained into a waste-liquid tank. In this exemplary embodiment, the caps 19*a* and the cap elevating unit 19*c* form a capping device. Alternatively, for example, the dummy ejection receptacle may be disposed at the side proximal to the carriage home position and included in the maintenance unit 19 with the caps 19*a* and the wiper blade 19*b*. Furthermore, two dummy ejection receptacles may be disposed at the carriage-home-position side and the dummy-ejection-position side.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposed ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumference of the flanges 31 to feed the rolled sheet 30 to the sheet feed path.

As illustrated in FIG. 3, the sheet feed section 3 includes a pair of sheet feed rollers 33, a registration roller 34, a registration pressing roller 35, and a driving unit 38. The driving unit 38 (see FIG. 12) includes, for example, a driving motor to drive the pair of sheet feed rollers 33, the registration roller 34, and the registration pressing roller 35. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2.

After the rolled sheet 30 is fed from the rolled sheet storage section 4, the sheet feed section 3 feeds the rolled sheet 30 forward (toward the left side in FIG. 2) from the rear side (right side in FIG. 2) of the apparatus body 1*a* to the recording area below the image forming section 2. When the rolled sheet 30 is fed to the recording area, the carriage 15 reciprocally moves back and forth in the sheet width direction and the recording heads 15*a* eject ink droplets in accordance with image information. In addition, while the rolled sheet 30 is intermittently fed forward, the recording heads 15*a* repeatedly eject ink droplets onto the rolled sheet 30 to record lines of a desired image on the rolled sheet 30. Thus, the whole image is formed on the rolled sheet 30 in accordance with the image information.

After image formation, the sheet cutting device 5 cuts the rolled sheet 30 to a desired length, and a sheet cut from the rolled sheet 30 is discharged to a sheet output tray at the front side of the apparatus main unit 1*a*.

Next, the sheet cutting device 5 in this exemplary embodiment is described with reference to FIGS. 4 to 8.

Figure 4:
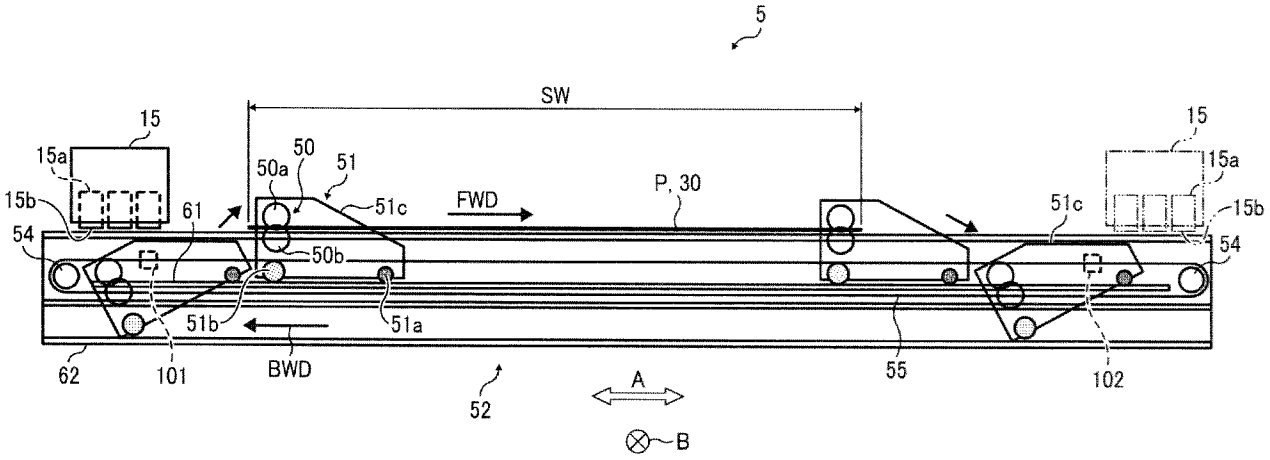
FIG. 4 is a schematic back view of a sheet cutting device of the inkjet recording apparatus illustrated in FIG. 1.

FIG. 4 is a schematic view of the sheet cutting device 5 seen from the back side of the apparatus body 1*a*.

The sheet cutting device 5 is disposed downstream from the image forming section 2 in the sheet feed direction (see FIG. 3) and has a cutter 50, a cutter unit 51, and a guide member 52 as illustrated in FIG. 4.

The cutter 50 is formed with circular blades 50*a* and 50*b*. The circular blades 50*a* and 50*b* are disposed opposing each other and rotatably held by the cutter unit 51. With movement of the cutter unit 51 in the sheet width direction indicated by the arrow A in FIG. 4, the circular blades 50*a* and 50*b* obtain a driving force to rotate. In other words, the cutter 50 cuts the rolled sheet 30 while rotating the circular blades 50*a* and 50*b*, thus allowing cutting of, e.g., a relatively thick rolled sheet. Additionally, the cutter 50 formed with the circular blades prevents a failure, such as uneven wearing of a particular portion which is likely to occur in a stationary blade. It is to be noted that the number of circular blades of the cutter 50 is not limited to two and may be three or more. Additionally, the configuration of the cutter 50 is not limited to the pair of the circular blades 50*a* and 50*b* in this exemplary embodiment. For example, the cutter may have a pair of one circular blade and one fixed blade.

The cutter unit 51 is reciprocally movable back and forth within a range of movement in the sheet width direction (hereinafter may be referred to as "cutter-unit movement range") indicated by an arrow R2 in FIG. 13. A first retracted position (left side in FIG. 13) and a second retracted position (right side in FIG. 13) of the cutter unit 51 are disposed at opposed ends of the cutter-unit movement range R2. The second retracted position is located at an end opposite the first retracted position in the cutter-unit movement range. At the first and second retracted positions, the cutter unit 51 is retracted from the sheet feed path downward in a thickness direction of the rolled sheet 30 (hereinafter, sheet thickness direction), that is, the vertical direction. Such a configuration prevents the cutter unit 51 from interfering with the carriage 15 at the first and second retracted positions. In this exemplary embodiment, the first retracted position corresponds to a home position of the cutter unit 51 (hereinafter, "cutter home position").

When the cutter unit 51 moves along a forward path (indicated by an arrow FWD in FIG. 4) from the second end side to the first end side of the apparatus body 1*a* (see FIG. 1), the cutter 50 cuts the rolled sheet 30. In other words, the cutter unit 51 moves from the cutter home position (the first retracted position) to the second retracted position while cutting the rolled sheet 30.

By contrast, when the cutter unit 51 moves along a backward path (indicated by an arrow BWD in FIG. 4) from the first end side to the second end side of the apparatus main unit 1*a* (see FIG. 1), the cutter unit 51 moves to the cutter home position at a state in which the cutter unit 51 is retracted from the sheet feed path downward in the vertical direction. As a result, on the backward path, the cutler unit 51 is separated from the sheet feed path (indicated by a solid line P in FIG. 4) so as not to block the sheet feed path.

At the opposed ends of the cutter-unit movement range R2, for example, a first detector 101 and a second detector 102, such as transmissive sensors or micro switches, are disposed to detect the cutter unit 51. The first detector 101 and the second detector 102 detect that the cutter unit 51 is placed at the first and second retracted positions, respectively. The controller 100 controls the cutter unit 51 based on the position of the cutter unit 51 detected with the first detector 101 and the second detector 102. In this exemplary embodiment, the first detector 101 and the second detector 102 form a cutter position detecting device.

A configuration of the cutter unit 51 is described below.

The cutter unit 51 has a driving roller 51*a* and a driven roller 51*b*, and holds the cutter 50 inside. The driving roller 51*a* is connected to a wire 55 extending between a pair of pulleys 54 at opposed ends of the apparatus body 1*a* in the sheet width direction. The wire 55 circulates in the sheet width direction via the pair of pulleys 54 rotated by a cutter-unit driving motor 57 (see FIG. 12). As a result, the driving roller 51*a*, while rotating, moves on an upper guide rail 61 with the circulation of the wire 55. The cutter unit 51 is movable in the sheet width direction with the movement of the driving roller 51*a*. The driven roller 51*b* is rotatably disposed away from the driving roller 51*a* in the sheet width direction. The driven roller 51*b* moves on the upper guide rail 61 along the forward path of the cutter unit 51 and on a lower guide rail 62 along the backward path. In other words, during the movement of the cutter unit 51, the driven roller 51*b* functions as a positioning member to position the cutter unit 51 with respect to the upper guide rail 61 and the lower guide rail 62. It is to be noted that the positioning member of the cutter unit 51 is not limited to the driven roller 51*b* but may be, for example, a circular-arc protrusion.

On switching the moving path between the forward path and the backward path, the cutter unit 51 pivots in the vertical direction around the driving roller 51*a*. Thus, the cutter unit 51 switches its position between a first position with which the cutter unit 51 cuts the rolled sheet 30 along the forward path and a second position with which the cutter unit 51 is retracted from the sheet feed path.

Figure 5A:
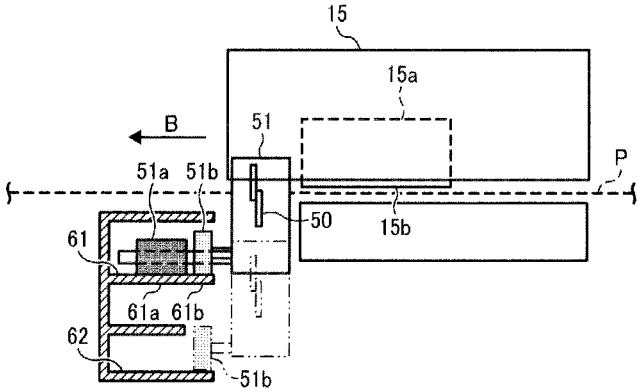
FIG. 5A is a partially cross-sectional side view of the sheet cutting device illustrated in FIG. 4.

As illustrated in FIG. 5A, the cutter unit 51 is disposed within the width of the carriage 15 in the sheet feed direction. In other words, the carriage 15 and the cutter unit 51 are arranged to overlap in the vertical direction so that the carriage movement range partially overlaps an area in which the cutter unit 51 moves along the forward path, thus reducing the width of the apparatus body 1*a* in the sheet feed direction. In the above-described arrangement of this exemplary embodiment, when the carriage 15 is placed at the carriage home position or the dummy ejection position, the cutter unit 51 moves along the forward path, thus preventing the cutter unit 51 from interfering with the carriage 15. Such movement control of the cutter unit 51 is performed by the controller 100 as described below. In FIG. 5A, a broken line P extending in the direction indicated by the arrow B represents the sheet feed path.

The driving roller 51*a* and the driven roller 51*b* are offset from each other in the sheet feed direction indicated by the arrow B. Specifically, the driven roller 51*b* is arranged upstream from the driving roller 51*a* in the sheet feed direction. As a result, with the driving roller 51*a* held on the upper guide rail 61, the driven roller 51*b* is movable between the upper guide rail 61 and the lower guide rail 62, thus allowing the cutter unit 51 to pivot around the driving roller 51*a*.

As illustrated in FIG. 4, the cutter unit 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter unit 51 moves along the backward path.

As illustrated in FIG. 4, the guide member 52 is a guide member to guide the movement of the cutter unit 51 in the sheet width direction, and includes the upper guide rail 61, extending in the sheet width direction for a length that is at least longer than the width (sheet feed width) of the sheet feed path indicated by an arrow SW, and the lower guide rail 62 disposed away from the sheet feed path downward in the vertical direction. The guide member 52 forms the forward path of the cutter unit 51 on the upper guide rail 61 and the backward path of the lower guide rail 62 on the lower guide rail 62. In this exemplary embodiment, the upper guide rail 61 and the lower guide rail 62 are formed as a single member (the guide member 52). Alternatively, the upper guide rail 61 and the lower guide rail 62 may be formed as separate members.

Figure 5B:
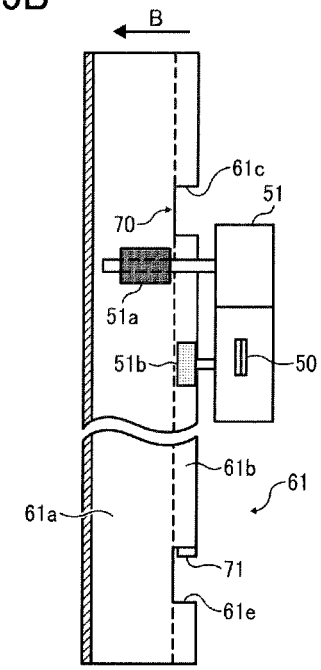
FIG. 5B is a partially cross-sectional plan view of the sheet cutting device illustrated in FIG. 4.

As illustrated in FIGS. 5A and 5B, the upper guide rail 61 has a driving-roller guide area 61*a* to guide the driving roller 51*a* in the sheet width direction and a driven-roller guide area 61*b* to guide the driven roller 51*b* so that the cutter unit 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails.

Figure 7:
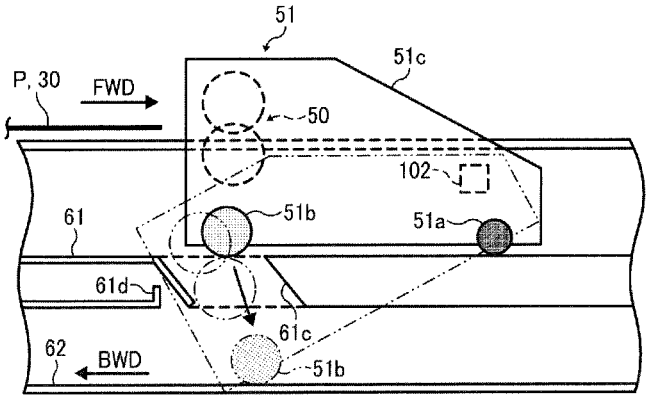
FIG. 7 is a schematic view of the cutter unit shifting to a backward path.

At a first end side of the driven-roller guide area 61*b* in the sheet width direction, a first connection path 61*c* is formed to switch the moving path of the cutter unit 51 from the forward path to the backward path. As illustrated in FIG. 7, the first connection path 61*c* is formed at the upper guide rail 61 so as to connect the forward path (indicated by an arrow FWD) on the upper guide rail 61 to the backward path (indicated by an arrow BWD) on the lower guide rail 62. Specifically, a predetermined portion of the upper guide rail 61 is cut out at the first end side in the sheet width direction and folded so as to slant downward at a certain angle, thus forming the first connection path 61*c*. Thus, the first connection path 61*c* allows the driven roller 51*b* to move from the upper guide rail 61 to the lower guide rail 62 after the rolled sheet is cut with the cutter 50. A lower end portion 61*d* of the upper guide rail 61 adjacent to the first connection path 61*c* is folded upward so as not to contact the driven roller 51*b* moving along the backward path.

Figure 6:
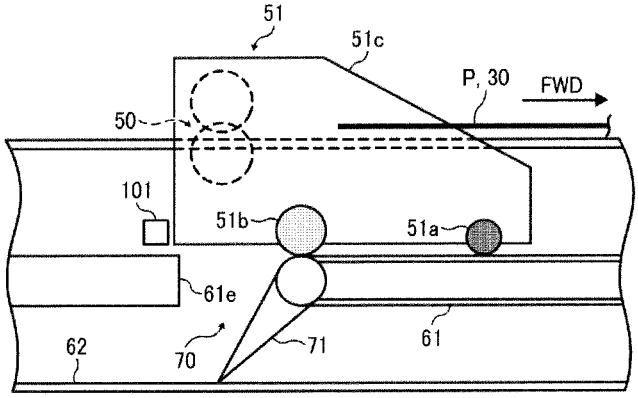
FIG. 6 is a schematic view of a cutter unit having returned to a rolled-sheet cutting area in the first exemplary embodiment.

As illustrated in FIG. 6, a moving mechanism 70 is disposed at a second end side of the driven-roller guide area 61*b* opposite the first end side in the sheet width direction. When the cutter unit 51 moves from the cutter home position indicated by a solid line in FIG. 10 to the opposite end in the sheet width direction, the moving mechanism 70 shifts the driven roller 51*b* from the lower guide rail 62 to the upper guide rail 61, that is, returns the cutter unit 51 to a cutting area (rolled-sheet cutting area) of the rolled sheet.

The moving mechanism 70 includes a second connection path 61*e* to connect the backward path on the lower guide rail 62 to the forward path on the upper guide rail 61, and a switching hook 71 disposed adjacent to the second connection path 61*e* at the upper guide rail 61.

The second connection path 61*e* is formed by cutting out a predetermined portion of the upper guide rail 61 at the second end side in the sheet width direction (see FIG. 5B).

Figure 10:
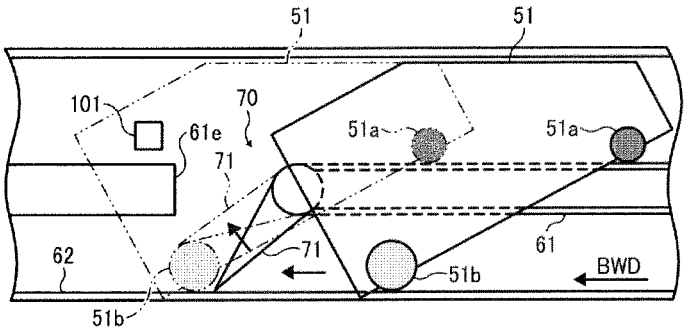
FIG. 10 is a schematic view of the cutter unit returning from the backward path to a home position.
Figure 11:
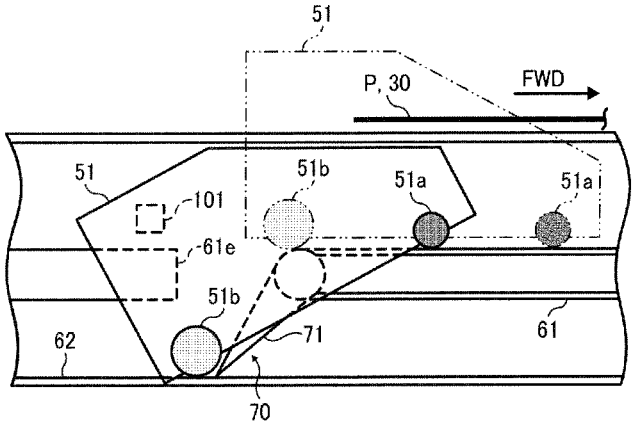
FIG. 11 is a schematic view of the cutter unit returning to a rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 10, when the cutter unit 71 moves along the backward path (indicated by an arrow BWD) to the second end side in the sheet width direction, the driven roller 51*b* contacts the switching hook 71 to pivot the switching hook 71 as indicated by a broken line. In this state, when the driven roller 51*b* further moves to the second end side in the sheet width direction, the switching hook 71 is separated from the driven roller 51*b* and returned by the urging member to an initial position, that is, a position indicated by a solid line in FIG. 10. At the initial position indicated by the solid line in FIG. 10, the switching hook 71 is tilted at a predetermined angle. Thus, as illustrated in FIG. 11, when the cutter unit 51 returns from the backward path to the forward path, the driven roller 51*b* can be moved from the lower guide rail 62 to the upper guide rail 61 via the switching hook 71. The switching hook 71 may be, for example, a leaf spring. In such a case, the urging member is not necessary.

The lower guide rail 62 guides the driven roller 51*b* of the cutter unit 51 moving along the backward path.

Next, operation of the sheet cutting device 5 is described with reference to FIGS. 6 to 11.

As illustrated in FIG. 11, before the rolled sheet 30 is cut, the cutter unit 51 is placed at the cutter home position (indicated by the solid line in FIG. 11) at the second end side in the sheet width direction. At this time, the first detector 101 is turned on, thus detecting that the cutter unit 51 is placed at the cutter home position. When an instruction for sheet cutting is received, the driving roller 51*a* is rotated via the wire 55 (see FIG. 4) to move the cutter unit 51. As a result, the cutter unit 51 moves from the cutter home position to the rolled-sheet cutting area (a position indicated by a broken line in FIG. 11), and the first detector 101 is turned off. Then, the cutter unit 51 moves along the forward path to the first end side in the sheet width direction. At this time, the cutter 50 cuts the rolled sheet 30 with the movement of the cutter unit 51.

Figure 8:
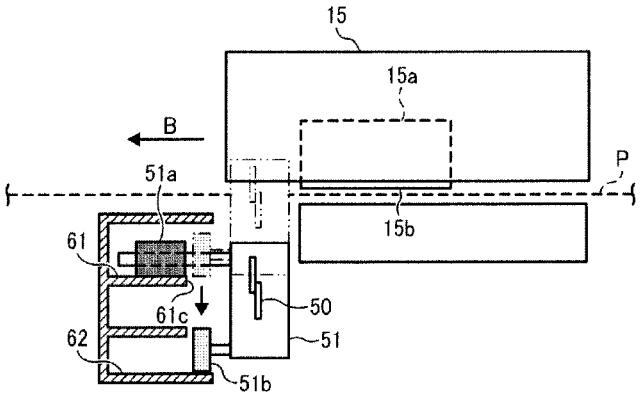
FIG. 8 is a partially cross-sectional side view of the sheet cutting device illustrated in FIG. 4 when the cutter unit shifts to the backward path.

Next, as illustrated in FIG. 7, when the cutter unit 51 moves along the forward path (indicated by an arrow FWD) to the first end side in the sheet width direction across the sheet feed path (indicated by a solid line P), the second detector 102 is turned on. Thus, by detecting the cutter unit 51 with the second detector 102, it is detected that the cutter unit 51 is placed at the second retracted position, and the cutting of the rolled sheet 30 ends. At this time, to switch the moving path of the cutter unit 51 from the forward path to the backward path, the cutter unit 51 pivots downward in the vertical direction around the driving roller 51*a* by its own weight. Specifically, when the driven roller 51*b* moving on the upper guide rail 61 arrives at the first connection path 61*c*, the driven roller 51*b* moves from the upper guide rail 61 to the lower guide rail 62 via the first connection path 61*c*. At this time, as illustrated in FIG. 8, with the driving roller 51*a* retained on the upper guide rail 61, only the driven roller 51*b* moves to the lower guide rail 62 by its own weight. As a result, in FIG. 7, the cutter unit 51 overlapping the sheet feed path indicated by a broken line P pivots to take a position with which the cutter unit 51 is movable along the backward path, that is, the position (indicated by a broken line in FIG. 7) with which the cutter unit 51 is retracted from the sheet feed path.

Figure 9:
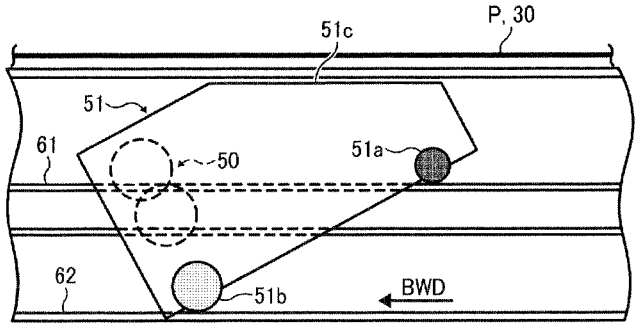
FIG. 9 is a schematic view of the cutter unit moving along the backward path.

Then, the wire 55 (see FIG. 4) is circulated in reverse to rotate the driving roller 51*a* in reverse, that is, in a direction opposite a direction in which the driving roller 51*a* rotates on the forward path. Thus, as illustrated in FIG. 9, with the position retracted from the sheet feed path indicated by the solid line P, the cutter unit 51 moves along the backward path (indicated by an arrow BWD) to the second end side in the sheet width direction. At this time, when the cutter unit 51 starts to move, the second detector 102 is turned off. On the backward path, the slanted face 51*c* is substantially parallel to the sheet feed path and, unlike on the forward path, the cutter unit 51 is retracted downward from the sheet feed path. Thus, even when the cutter unit 51 moves along the backward path, the rolled sheet 30 can be fed along the sheet feed path and the carriage 15 (see FIG. 4) is movable in the sheet width direction.

Next, as illustrated in FIG. 10, when the cutter unit 51 moves to the second end side in the sheet width direction and arrives at a position adjacent to the moving mechanism 70, the driven roller 51*b* contacts the switching hook 71. With the movement of the cutter unit 51, the driven roller 51*b* pushes up the switching hook 71 as indicated by a broken line an FIG. 10, and moves from the backward path side (the right side of the switching hook 71 in FIG. 10) to the second end side in the sheet width direction, that is, the side of the second connection path 61*e* (the left side of the switching hook 71 in FIG. 10). When the driven roller 51*b* moves to the side of the second connection path 61*e*, the switching hook 71 is separated from the driven roller 51*b* and returned by the urging member to the initial position, that is, the position indicated by the solid line in FIG. 10. At this time, the first detector 101 is turned on, thus detecting that the cutter unit 51 is placed at the cutter home position.

Thus, the reciprocal movement of the cutter unit 51 in the sheet width direction is finished. If the rolled sheet 30 is subsequently fed, the above-described reciprocal movement is repeated.

Next, a configuration of the controller 100 is described with reference to FIG. 12.

As illustrated in FIG. 12, the first detector 101, the second detector 102, the encoder sensor 103, the recording heads 15*a*, the cap elevating unit 19*c*, the suction units 19*d*, the driving unit 38, the cutter-unit driving motor 57, a power button 104, an operation-and-display unit 105, an external device 150, and the carriage driving motor 21 are connected to the controller 100. The controller 100 includes a micro computer including, for example, a central processing unit (CPU), a random access memory (RAM), a read-only memory (ROM), and an input-output interface. In this exemplary embodiment, various motors are controlled by a single controller, that is, the controller 100. However, it is to be noted that the controller 100 may be two or more controllers to control different motors. For example, the controller 100 may include a first controller to control the recording heads 15*a*, the cap elevating unit 19*c*, the suction units 19*d*, the carriage driving motor 21, and the driving unit 38, and a second controller to control the cutter-unit driving motor 57. Furthermore, for example, the above-described first controller may include an image formation control unit to control the recording heads 15*a* and the carriage driving motor 21, a maintenance-and-recovery control unit to control the cap elevating unit 19*c* and the suction units 19*d*, and a sheet feeding control unit to control the driving unit 38.

The first detector 101 is disposed at a side of the first retracted position (left side in FIG. 13) in the cutter-unit movement range R2 to detect the cutter unit 51 at the first retracted position. The second detector 102 is disposed at a side of the second retracted position (right side in FIG. 13) in the cutter-unit movement range R2 to detect the cutter unit 51 at the second retracted position. As described above, the encoder sensor 103 is mounted at the carriage 15 to read the encoder sheet 16 to detect the main scanning position of the carriage 15. Signals representing detection results of the first detector 101, the second detector 102, and the encoder sensor 103 are input to the controller 100.

The power button 104 is disposed at a predetermined position of the apparatus body 1*a* (see FIG. 1) so that a user can press the power button 104 down to turn the power of the inkjet recording apparatus 1 on and off.

The operation-and-display unit 105 is disposed at the apparatus body 1*a* to receive instructions of operation requests from a user or signals indicating continuation/discontinuation of printing operation on detection of an abnormality of the cutter unit 51 and to display messages, such as error messages. In particular, the operation-and-display unit 105 displays an error notice indicating occurrence of abnormality of initial operation of the cutter unit 51. The term "initial operation" of the cutter unit (hereinafter, "cutter initial operation") means operation to move the cutter unit 51 to the first retracted position, i.e., the cutter home position when the power is turned on.

Based on detection results of the first detector 101 and the second detector 102, the controller 100 determines whether or not cutter initial operation is to be performed. When the controller 100 determines that cutter initial operation is not to be performed, the operation-and-display unit 105 displays the error notice in response to a control signal received from the controller 100. In this exemplary embodiment, the controller 100 and the operation-and-display unit 105 having the above-described functions form a notification device. Besides or instead of displaying the error notice on the operation-and-display unit 105, the abnormality of cutter initial operation may be notified to a user by making an alert sound and/or turning on an indicator. Alternatively, besides displaying the error notice on the operation-and-display unit 105, for example, the error notice may be displayed on a screen of the external device 150 connected to the controller 100.

The controller 100 creates data for recording a desired image on the rolled sheet 30 in accordance with image information transferred from, e.g., the external device 150 connected to the controller 100 from the outside of the inkjet recording apparatus 1, outputs the data to the recording heads 15*a*, and controls driving of the recording heads 15*a*. The controller 100 also controls the carriage driving motor 21 and the driving unit 38, as well as the recording heads 15*a*. As described above, the controller 100 controls the recording heads 15*a*, the carriage driving motor 21, and the driving unit 38 to eject ink droplets at proper timings to record a desired image on a recording area of the rolled sheet 30.

When the controller 100 determines based on a signal input from the encoder sensor 103 that the carriage 15 is placed at the carriage home position or the dummy ejection position, the controller 100 causes the cutter unit 51 to move to the first end in the sheet width direction along the forward path (see FIG. 4) to cut the rolled sheet 30. Thus, the rolled sheet 30 is cut by the above-described sheet cutting operation.

When the cutter unit 51 is detected by the second detector 102 after the sheet cutting operation, the controller 100 causes the cutter-unit driving motor 57 to rotate in reverse, thus moving the cutter unit 51 to the second side in the sheet width direction along the backward path with the cutter unit 51 retracted from the sheet feed path. At this time, the controller 100 controls the driving unit 38 so that the rolled sheet 30 can be fed to the downstream side in the sheet feed direction while the cutter unit 51 moves along the backward path. Thus, while the cutter unit 51 moves along the backward path, the rolled sheet 30 can be fed for, e.g., image recording.

The controller 100 determines whether or not a predetermined non-activation time of nozzles has elapsed. If the controller 100 determines that the predetermined non-activation time has elapsed, the controller 100 causes the carriage 15 to move to the dummy ejection position and the recording heads 15*a* to perform dummy ejection. Alternatively, for example, the dummy ejection may be performed when the number of times nozzles are used for image recording reaches a predetermined threshold.

Under certain conditions, such as, on turning the power on or after printing operation, the cap elevating unit 19*c* is activated to cap the nozzle faces 15*b* of the recording heads 15*a* with the caps 19*a*. With the nozzle faces 15*b* capped with the caps 19*a*, the controller 100 drives the suction units 19*d* to discharge ink to the caps 19*a*. The suction units 19*d* may be driven each time the capping operation is performed, or selectively driven based on conditions of the apparatus.

As described above, in this exemplary embodiment, the controller 100 determines whether or not cutter initial operation is to be performed, based on detection results of the first detector 101 and the second detector 102. When the controller 100 determines that cutter initial operation is to be performed, the controller 100 drives the cutter-unit driving motor 57 to perform the cutter initial operation. By contrast, when the controller 100 determines that cutter initial operation is not to be performed, the controller 100 causes the operation-and-display unit 105 to display the error notice to notify a user of abnormality of the cutter initial operation without performing the cutter initial operation. In this exemplary embodiment, the controller 100 having the above-described function serves as a control device.

Next, a control process of cutter initial operation performed by the controller 100 when the power is turned on is described with reference to FIGS. 13 and 14.

In this exemplary embodiment, when the power is turned on, the carriage 15 is assumed to be always on standby at the dummy ejection position.

Figure 14:
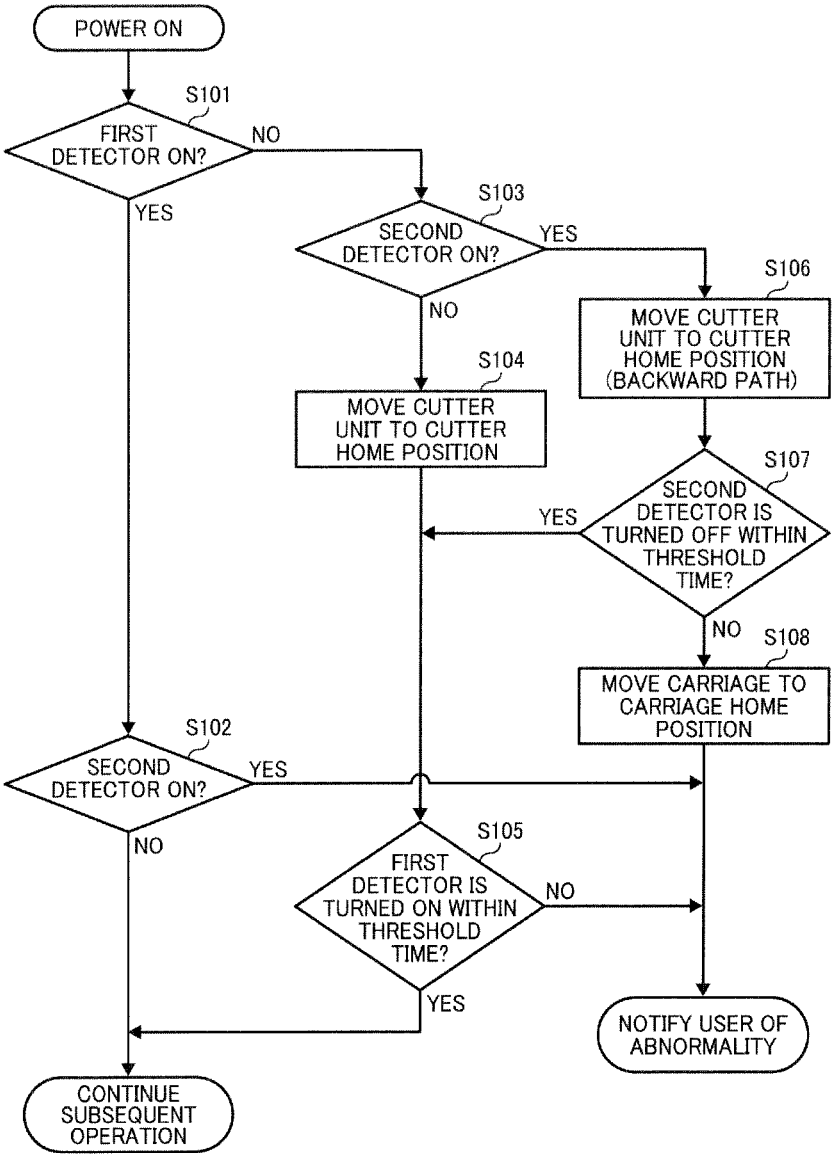

As illustrated in FIG. 14, when the power is turned on, at S101 the controller 100 determines whether or not the first detector 101 is turned on. When the controller 100 determines that the first detector 101 is turned on (YES at S101), at S102 the controller 100 determines whether or not the second detector 102 is turned on.

When the controller 100 determines at S102 that the second detector 102 is not turned on, i.e., is off (NO at S102), the controller 100 determines that the cutter unit 51 is normally placed at the cutter home position and performs subsequent operation (e.g., carriage initial operation to return the carriage 15 to the carriage home position or capping operation). At this time, the cutter unit 51 is placed at the cutter home position at which the cutter unit 51 does not contact the carriage 15. As a result, even if the carriage 15 is moved by carriage initial operation, the cutter unit 51 does not contact the carriage 15. At this time, since the cutter unit 51 is placed at the cutter home position, the controller 100 does not perform the cutter initial operation.

If the controller 100 determines at S102 that the second detector 102 is turned on (YES at S102), both the first detector 101 and the second detector 102 could detect the cutter unit 51 when the power is turned on. In such a case, the first detector 101 or the second detector 102 is likely to be out of order. Then, the controller 100 determines that cutter initial operation is not to be performed, the controller 100 notifies a user of abnormality via the operation-and-display unit 105 without performing the cutter initial operation.

When the controller 100 determines at S101 that the first detector 101 is not turned on, i.e., is off (NO at S101), at S103 the controller 100 determines whether or not the second detector 102 is turned on. When the controller 100 determines at S103 that the second detector 102 is not turned on, i.e., is off (NO at S103), the cutter unit 51 is likely to be stopping midway in the cutter-unit movement range. Then, at S104 the controller 100 performs the cutter initial operation to return the cutter unit 51 to the cutter home position.

At S105, the controller 100 determines whether or not the first detector 101 is turned on within a threshold time in the cutter initial operation. When the controller 100 determines that the first detector 101 is turned on within the threshold time (YES at S105), the controller 100 determines that the cutter initial operation is normally finished and performs subsequent operation (e.g., carriage initial operation to return the carriage 15 to the carriage home position or capping operation). By contrast, when the controller 100 determines that the first detector 101 is not turned on within the threshold time (NO at S105), the controller 100 determines that the cutter initial operation is not normally finished due to some abnormality that hampers movement of the cutter unit 51 and immediately notifies a user of abnormality via the operation-and-display unit 105. Here, the threshold time of S105 is set to be a time sufficient to move the cutter unit 51 to the cutter home position in the cutter initial operation.

When the controller 100 determines at S103 that the second detector 102 is turned on (YES at S103), the controller 100 determines that the cutter unit 51 is placed at the second retracted position. At S106, the controller 100 performs the cutter initial operation to return the cutter unit 51 to the cutter home position. In the cutter initial operation, the cutter unit 51 moves on the backward path (see FIG. 13) toward the cutter home position.

At S107, the controller 100 determines whether or not the second detector 102 is turned off within a threshold time in the cutter initial operation of S106. When the controller 100 determines that the second detector 102 is turned off within the threshold time (YES at S107), the process goes to S105 and the controller 100 performs processing of S105 and subsequent steps. By contrast, when the controller 100 determines that the second detector 102 is not turned off within the threshold time (NO at S107), the controller 100 determines that the cutter unit 51 stays at the second retracted position, e.g., because the cutter unit 51 cannot be normally driven. Then, at S108, the controller 100 moves the carriage 15 to the carriage home position and notifies a user of abnormality via the operation-and-display unit 105. As a result, even if the cutter initial operation cannot be normally finished, the recording heads 15*a* can be capped at the carriage home position, thus preventing ink from clogging the nozzles due to drying.

Here, the threshold time of S107 is set to be a time shorter than, e.g., the threshold time of S105 and sufficient to move the cutter unit 51 outside a detection range of the second detector 102 in the cutter initial operation.

As described above, for the inkjet recording apparatus 1 according to this exemplary embodiment, when the power is turned on, the controller 100 determines whether or not the cutter initial operation is to be performed, based on detection results of the first detector 101 and the second detector 102. As a result, in a case in which the cutter unit 51 might interfere with the carriage 15 when the cutter unit 51 is moved upon power on of the inkjet recording apparatus 1, the inkjet recording apparatus 1 can notify a user of abnormality without performing the cutter initial operation. By contrast, in a case in which the cutter unit 51 would not interfere with the carriage 15 when the cutter unit 51 is moved upon power on of the inkjet recording apparatus 1, the inkjet recording apparatus 1 can perform the cutter initial operation without notifying a user of abnormality. As described above, when the power is turned on, the inkjet recording apparatus 1 according to this exemplary embodiment can perform the cutter initial operation while preventing the cutter unit 51 and the carriage 15 from contacting each other.

In addition, for the inkjet recording apparatus 1 according to this exemplary embodiment, when it is determined that the cutter initial operation is not to he performed, the controller 100 notifies a user of abnormality of the cutter initial operation via the operation-and-display unit 105 without performing the cutter initial operation. For example, in a case in which the position of the cutter unit 51 cannot be detected due to, e.g., failure of the first detector 101 and the second detector 102, if the cutter unit 51 is moved by the cutter initial operation, the cutter unit 51 might interfere with the carriage 15. Hence, in this exemplary embodiment, the controller 100 notifies a user of abnormality without performing the cutter initial operation. Such a configuration can prevent the cutter unit 51 from contacting the carriage 15.

Furthermore, for the inkjet recording apparatus 1 according to this exemplary embodiment, when, upon power on of the inkjet recording apparatus 1, the carriage 15 is placed at the dummy ejection position and the first detector 101 detects that the cutter unit 51 is not placed at the cutter home position (NO at S101), at S104 or S106 the cutter initial operation is performed before the step S108 or movement of the carriage 15 in the carriage initial operation. In such a case, the carriage 15 is placed at the dummy ejection position at which the carriage 15 does not contact the cutter unit 51. As a result, even when the cutter initial operation is performed, the cutter unit 51 does not contact the carriage 15. Thus, the inkjet recording apparatus 1 can perform the cutter initial operation without moving the carriage 15, thus simplifying control operation.

As described above, in this exemplary embodiment, in the process of the cutter initial operation illustrated in FIG. 14, the cutter initial operation is performed at S106 before movement of the carriage 15 at S108. However, it is to be noted that the process is not limited to the above-described order. For example, as illustrated in FIG. 15, the cutter initial operation may be performed at S408 is performed after movement of the carriage 15 at S406.

Figure 15:
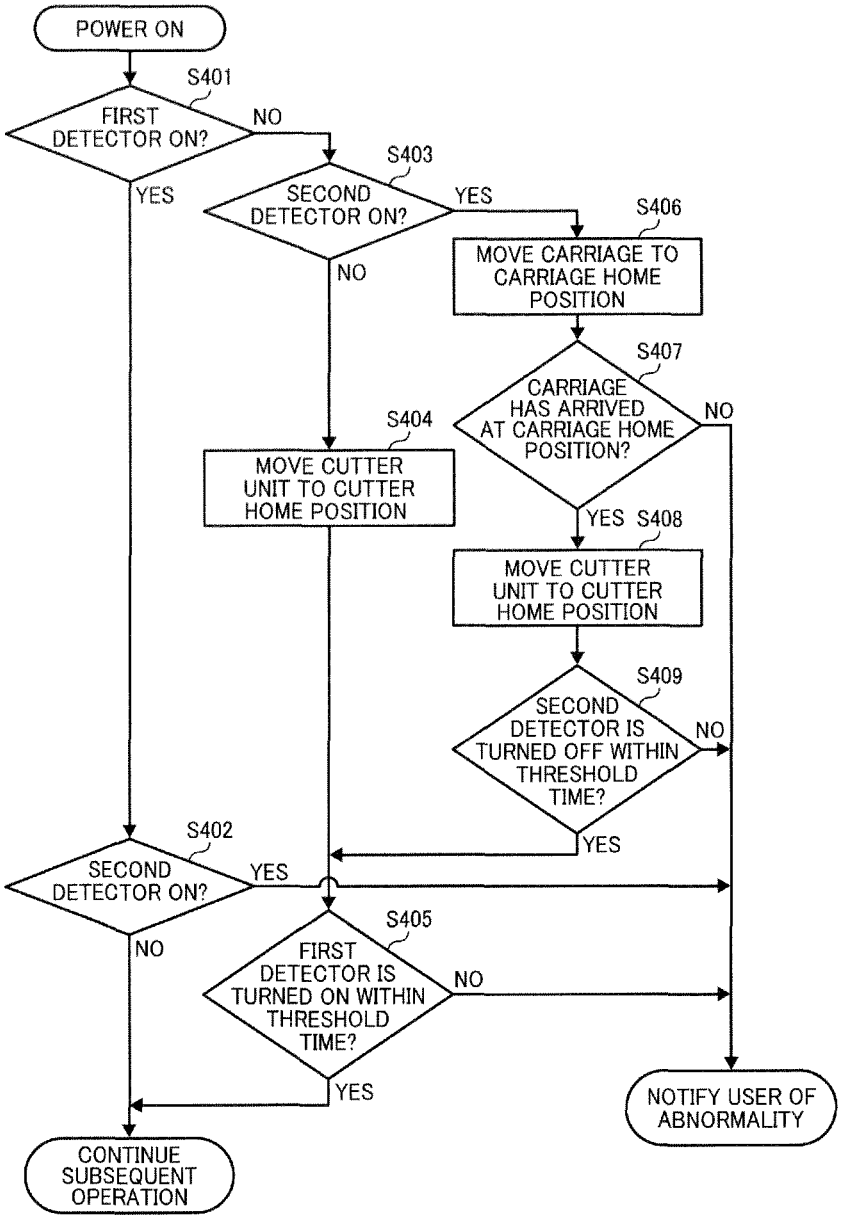
FIG. 15 is a flow chart of a variation of the process of cutter initial operation illustrated in FIG. 14.

Here, steps S401 to S405 illustrated in FIG. 15 are the same as the steps S101 to S105 illustrated in FIG. 14. In the process of the cutter initial operation illustrated in FIG. 15, when the controller 100 determines at S403 that the second detector 102 is turned on (YES at S403), at S406 the controller 100 moves the carriage 15 to the carriage home position. For example, after the carriage 15 contacts an inner wall surface of the carriage home position side of the apparatus body 1*a* (see FIG. 1), the controller 100 drives the carriage driving motor 21 to perform reverse rotation to move the carriage 15 to the carriage home position disposed at a certain distance away from the inner wall surface of the apparatus body 1*a*.

At S407, the controller 100 determines whether or not the carriage 15 arrives at the carriage home position. For example, the controller 100 can determine whether or not the carriage 15 arrives at the carriage home position by monitoring a distance at which the carriage 15 moves after contacting the inner wall surface of the apparatus body 1*a* based on information from the encoder sensor 103. When the controller 100 determines that the carriage 15 does not arrive at the carriage home position (NO at S407), some failure is likely to have hampered movement of the carriage 15. Then, the controller 100 immediately notifies a user of abnormality.

By contrast, when the controller 100 determines that the carriage 15 arrives at the carriage home position (YES at S407), at S408 the controller 100 performs the cutter initial operation. At S409, the controller 100 determines whether or not the second detector 102 is turned off within a threshold time in the cutter initial operation. When the second detector 102 is not turned off within the threshold time (NO at S409), the controller 100 immediately notifies a user of abnormality. By contrast, when the second detector 102 is turned off within the threshold time (YES at S409), at S405 the controller 100 determines whether or not the first detector 101 is turned on within a threshold time. When the first detector 101 is not turned on within the threshold time (NO at S405), the controller 100 immediately notifies a user of abnormality. By contrast, when the controller 100 determines that the first detector 101 is turned on within the threshold time (YES at S405), the controller 100 determines that the cutter initial operation is normally finished and performs subsequent operation (e.g., carriage initial operation to return the carriage 15 to the carriage home position or capping operation).

As described above, according to the process illustrated in FIG. 15, like the process illustrated in FIG. 14, when the power is turned on, the cutter initial operation can be performed while preventing the cutter unit 51 and the carriage 15 from contacting each other.

In this exemplary embodiment, the process of the cutter initial operation is described assuming that the carriage 15 is on standby at the dummy ejection position when the power is turned on. However, it is to be noted that the position of the carriage 15 is not limited to the dummy ejection position. For example, when the power is turned on, the carriage 15 may be on standby at the capping position. In such a case, since the caps 19*a* and the cap elevating unit 19*c* are controlled so as to cap the nozzle faces 15*b* before sheet cutting, capping operation is performed when the power is turned on. As described above, when capping operation is performed upon power on of the inkjet recording apparatus 1, a user cannot move the carriage 15. As a result, even when the cutter initial operation is performed, the cutter unit 51 does not contact the carriage 15. Hence, when it is detected that the cutter unit 51 is not placed at the cutter home position upon power on of the inkjet recording apparatus 1, the cutter initial operation is performed before the carriage 15 is moved. In such a case, like the above-described processes, when the power is turned on, the cutter initial operation can be performed while preventing the cutter unit 51 and the carriage 15 from contacting each other.

In addition, in this exemplary embodiment, the carriage home position and the capping position of the carriage 15 are identical. However, it is to be noted that the carriage home position and the capping position may be different.

Second Exemplary Embodiment

Figure 16:
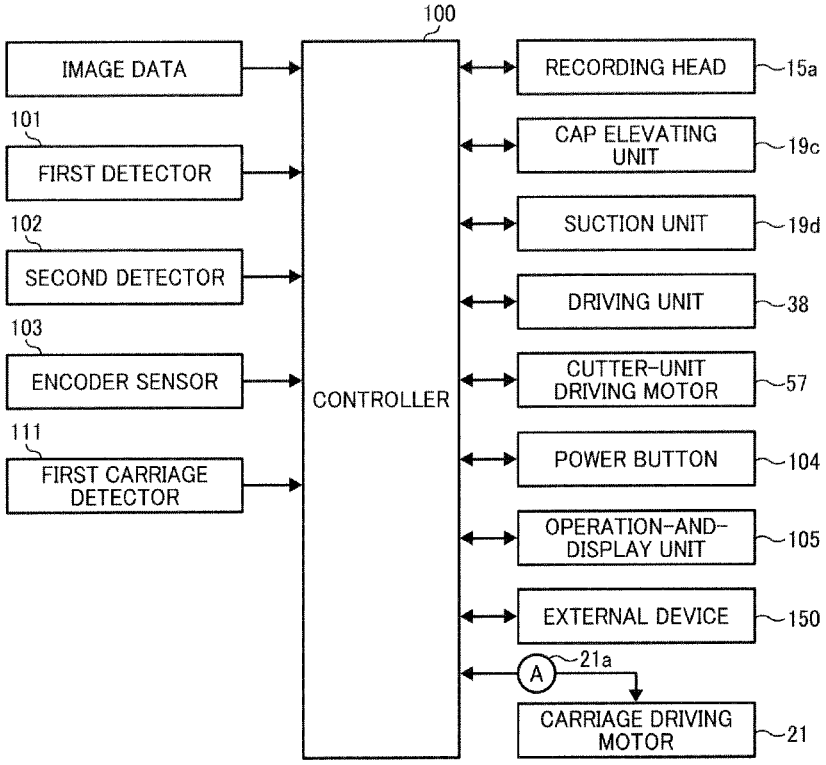
FIG. 16 is a schematic block diagram of a control configuration of an inkjet recording apparatus according to a second exemplary embodiment.

Next, an inkjet recording apparatus according to a second exemplary embodiment of this disclosure is described with reference to FIGS. 16 to 18.

In this second exemplary embodiment, the configuration of a controller and the process of cutter initial operation partially differ from those of the first exemplary embodiment. Except for the differences, the inkjet recording apparatus according to this second exemplary embodiment has the same configuration as the inkjet recording apparatus according to the first exemplary embodiment. Therefore, the same reference codes are allocated to the same components and elements as those of the first exemplary embodiment illustrated in FIGS. 1 to 15, and features of the second exemplary embodiment differing from the first exemplary embodiment are mainly described below.

First, like the controller in the first exemplary embodiment, a controller 100 according to this second exemplary embodiment is connected to a carriage driving motor 21. The carriage driving motor 21 is connected to an ammeter 21*a* that detects a driving current of the carriage driving motor 21, and the ammeter 21*a* is connected to the controller 100 via an analog-to-digital (A/D) converter. The moving load of the carriage 15 is detected based on a current value indicating the amount of the driving current of the carriage driving motor 21 detected by the ammeter 21*a*. Thus, the controller 100 can easily obtain the moving load of the carriage 15 based on the driving current of the carriage driving motor 21. The current value of the carriage driving motor 21 is proportional to the moving load of the carriage 15, and as the current value increases, the moving load also increases. Alternatively, the moving load of the carriage 15 may be detected based on the motor torque of the carriage driving motor 21.

The controller 100 compares the current value detected with the ammeter 21*a* with a preset threshold value. If the current value is the threshold value or more, the controller 100 stops the carriage driving motor 21. The threshold value is a current value corresponding to a load applied to the carriage driving motor 21, for example, when the carriage 15 contacts a rolled sheet after a cut jam or other foreign substance, that is, a current value greater than a driving current in a steady state.

In addition, the controller 100 in this exemplary embodiment is connected to a first carriage detector 111. Of opposed ends of a carriage movement range R1 illustrated in FIG. 17, the first carriage detector 111 is disposed at an end proximal to a carriage home position to detect that the carriage 15 is placed at the carriage home position, i.e., capping position. In this exemplary embodiment, the first carriage detector 111 serves as a carriage position detecting device.

Next, a control process of cutter initial operation performed by the controller 100 when the power is turned on is described with reference to FIGS. 17 and 18.

Figure 17:
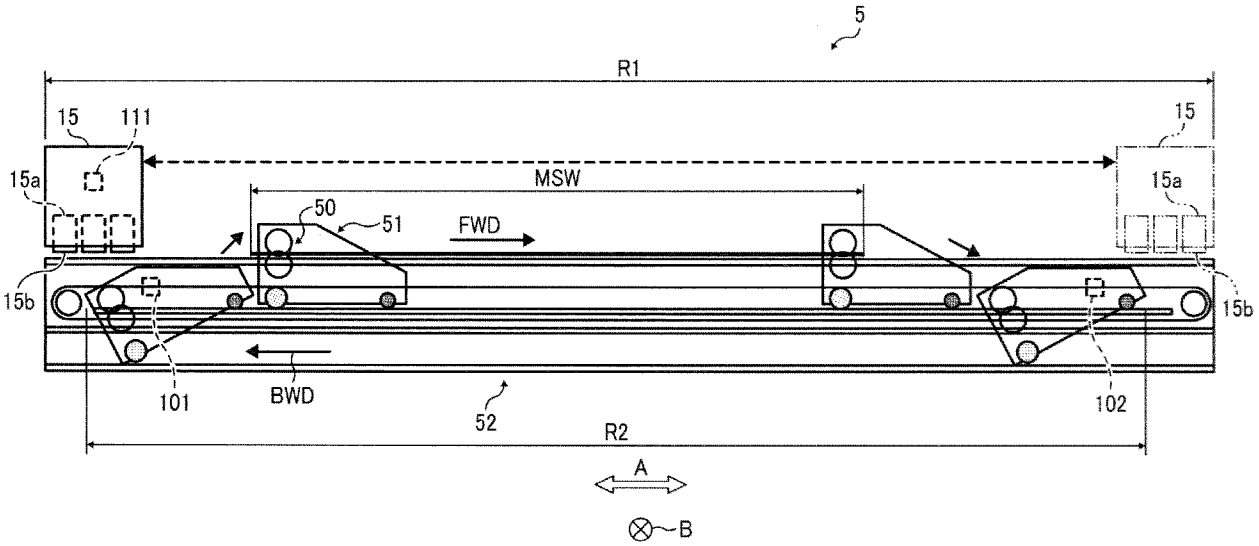
FIG. 17 is a schematic back view of the inkjet recording apparatus according to the second exemplary embodiment of this disclosure.

In this exemplary embodiment, when the power is turned on, the carriage 15 is on standby at the carnage home position (indicated by a solid line in FIG. 17) or a dummy ejection position (indicated by a broken line in FIG. 17).

As illustrated in FIG. 17, when the power is turned on, at S201 the controller 100 determines whether or not the first detector 101 is turned on. Based on determination results of S201, the controller 100 performs step S202 or S203 and subsequent steps. The steps S201 to S203 are the same as the steps S101 to S103 illustrated in FIG. 14, and descriptions thereof are omitted here.

When the controller 100 determines at S203 that the second detector 102 is turned on (YES at S203), at S204 the controller 100 starts carriage home position detecting operation. In the carriage home position detecting operation, the carnage 15 is moved to the carriage home position at a predetermined moving speed. At this time, when the carriage 15 is already placed at the carriage home position, the carriage home position detecting operation is omitted. The predetermined moving speed is set to be a speed at which the carriage 15 would not be damaged, for example, even if the carriage 15, during movement, contacts the cutter unit 51 or other foreign substance. In addition, during the carriage home position detecting operation, it is detected whether or not the carriage 15 contacts foreign substance, based on information from the ammeter 21*a* or the encoder sensor 103.

After the start of the carriage home position detecting operation, at S205 the controller 100 detects whether or not the first carriage detector 111 is turned on. When the controller 100 determines that the first carriage detector 111 is not turned on, i.e., is off (NO at S205), the controller 100 determines that the carriage 15 is likely to have contacted foreign substance during movement, and immediately notifies a user of abnormality.

By contrast, when the controller 100 determines that the first carriage detector 111 is turned on (YES at S205), at S206 the controller 100 performs cutter initial operation to move the cutter unit 51 to the cutter home position. At S207, the controller 100 determines whether or not the second detector 102 is turned off within a threshold time in the cutter initial operation. When the second detector 102 is not turned off within the threshold time (NO at S207), the controller 100 immediately notifies a user of abnormality. By contrast, when the second detector 102 is turned off within the threshold time (YES at S207), at S208 the controller 100 determines whether or not the first detector 101 is turned on within a threshold time. When the first detector 101 is not turned on within the threshold time (NO at S208), the controller 100 immediately notifies a user of abnormality. By contrast, when the controller 100 determines that the first detector 101 is turned on within the threshold time (YES at S208), the controller 100 determines that the cutter initial operation is normally finished and performs subsequent operation (e.g., carriage initial operation to return the carriage 15 to the carriage home position or capping operation).

Alternatively, when the controller 100 determines at S203 that the second detector 102 is not turned on, i.e., is off (NO at S203), the controller 100 cannot specify the position of the cutter unit 51. Then, at S209, the controller 100 determines whether or not the first carriage detector 111 is turned on to detect the position of the carriage 15. By contrast, when the controller 100 determines that the first carriage detector 111 is turned on (YES at S209), at S210 the controller 100 performs cutter initial operation to move the cutter unit 51 to the cutter home position. At this time, since it is confirmed that the carriage 15 is placed at the carriage home position, the cutter unit 51 does not contact the cutter unit 51 in the cutter initial operation. At S211, the controller 100 determines whether or not the first detector 101 is turned on within a threshold time. When the first detector 101 is not turned on within the threshold time (NO at S211), the controller 100 determines that the cutter unit 51 is likely to having contacted foreign substance during movement, and immediately notifies a user of abnormality. By contrast, when the controller 100 determines that the first detector 101 is turned on within the threshold time (YES at S211), the controller 100 determines that the cutter initial operation is normally finished and performs subsequent operation (e.g., carriage initial operation to return the carriage 15 to the carriage home position or capping operation).

Alternatively, when the controller 100 determines at S209 that the first carriage detector 111 is not turned on, i.e., is off (NO at S209), the controller 100 cannot specify the position of the carriage 15. Then, at S212, the controller 100 moves the carriage 15 to the carriage home position at a predetermined moving speed. During the movement of the carriage 15, it is detected whether or not the carriage 15 contacts foreign substance, based on information from the ammeter 21*a* or the encoder sensor 103. The predetermined moving speed of S212 is the same as a moving speed of the carriage 15 in carriage home position detecting operation of S204.

After performing the step S212, at S213 the controller 100 determines whether or not the first carriage detector 111 is turned on. When the controller 100 determines that the first carriage detector 111 is not turned on, i.e., is off (NO at S213), the controller 100 determines that the carriage 15 is likely to have contacted foreign substance during movement, and immediately notifies a user of abnormality.

By contrast, when the controller 100 determines he first carriage detector 111 is turned on (YES at S213), the controller 100 performs the step S210 and subsequent steps.

As described above, the inkjet recording apparatus 1 according to this exemplary embodiment has an effect equivalent to that of the first exemplary embodiment, and also has the following effect.

That is, for the inkjet recording apparatus 1 according to this exemplary embodiment, when it is detected that the cutter unit 51 is not placed at the cutter home position upon power on of the inkjet recording apparatus 1, the controller 100 determines whether or not the carriage 15 is to be moved before the cutter initial operation is performed, based on detection results of the first carriage detector 111 (see S209). As a result, in a case in which the carriage 15 is placed at the carriage home position upon power on of the inkjet recording apparatus 1, the cutter unit 51 does not contact the carriage 15 even if the cutter unit 51 is moved. Thus, the inkjet recording apparatus 1 can perform the cutter initial operation without moving the carriage 15. By contrast, in a case in which the carriage 15 is not placed at the carriage home position upon power on of the inkjet recording apparatus 1, if the cutter initial operation is performed, the cutter unit 51 might contact the carriage 15. Hence, in this exemplary embodiment, after the carriage 15 is moved, the cutter initial operation is performed. As described above, when the power is turned on, the inkjet recording apparatus 1 according to this exemplary embodiment can perform the cutter initial operation while preventing the cutter unit 51 and the carriage 15 from contacting each other.

In addition, the inkjet recording apparatus 1 according to this exemplary embodiment can detect, with a single carriage detector, i.e., the first carriage detector 111, that the carriage 15 is placed at the carriage home position and the capping position. Such a configuration can simplify the detector of the carriage 15.

In addition, when the carriage 15 is not detected with the first carriage detector 111 (NO at S209), the inkjet recording apparatus 1 according to this exemplary embodiment performs the cutter initial operation after moving the carriage 15 to the carriage home position (S212). In other words, when the carriage 15 might interfere with the cutter unit 51, the inkjet recording apparatus 1 moves the carriage 15 and then performs the cutter initial operation. Such a configuration can perform the cutter initial operation while preventing the carriage 15 from contacting the cutter unit 51.

Third Exemplary Embodiment

Figure 19:
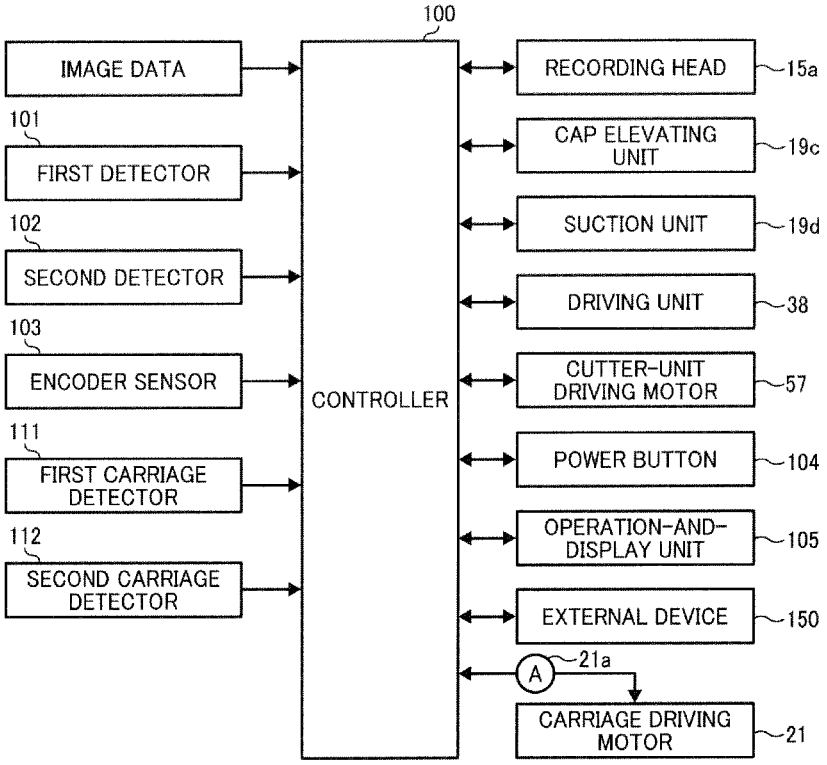
FIG. 19 is a schematic block diagram of a control configuration of an inkjet recording apparatus according to a third exemplary embodiment.

Next, an inkjet recording apparatus according to a third exemplary embodiment of this disclosure is described with reference to FIGS. 19 to 21.

In this third exemplary embodiment, the configuration of a controller and the process of cutter initial operation partially differ from those of the first and second exemplary embodiments. Except for the differences, the inkjet recording apparatus according to this third exemplary embodiment has the same configuration as the inkjet recording apparatus according to any of the first and second exemplary embodiments. Therefore, the same reference codes are allocated to the same components and elements as those of the first and second exemplary embodiments illustrated in FIGS. 1 to 18, and features of the third exemplary embodiment differing from the first and second exemplary embodiments are mainly described below.

The controller 100 according to this third exemplary embodiment has the same configuration as the controller according to the second exemplary embodiment, and is also connected to a second carriage detector 112. Of opposed ends of a carriage movement range R1 illustrated in FIG. 20, the second carriage detector 112 is disposed at an end opposite a carriage home position (capping position) to detect that the carriage 15 is placed at a dummy ejection position. In this exemplary embodiment, a first carriage detector 111 and the second carriage detector 112 serve as a carriage position detecting device.

Next, a control process of cutter initial operation performed by the controller 100 when the power is turned on is described with reference to FIGS. 20 and 21.

Figure 20:
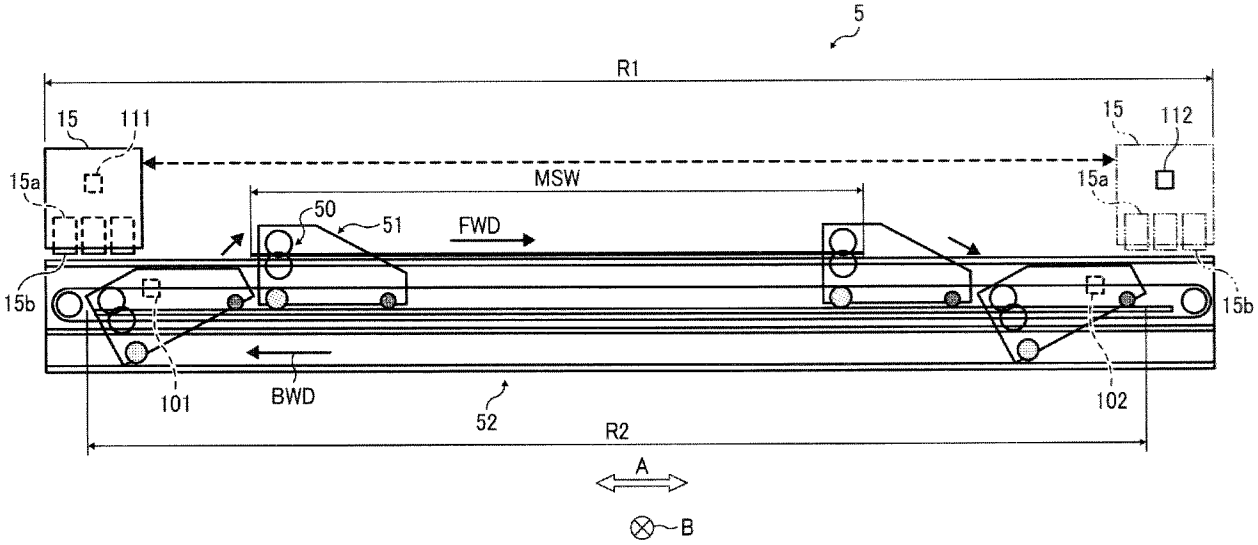
FIG. 20 is a schematic back view of the inkjet recording apparatus according to the third exemplary embodiment of this disclosure.

In this exemplary embodiment, when the power is turned on, the carriage 15 is on standby at the carriage home position (indicated by a solid line in FIG. 20) or the dummy ejection position (indicated by a broken line in FIG. 20).

Figure 18:
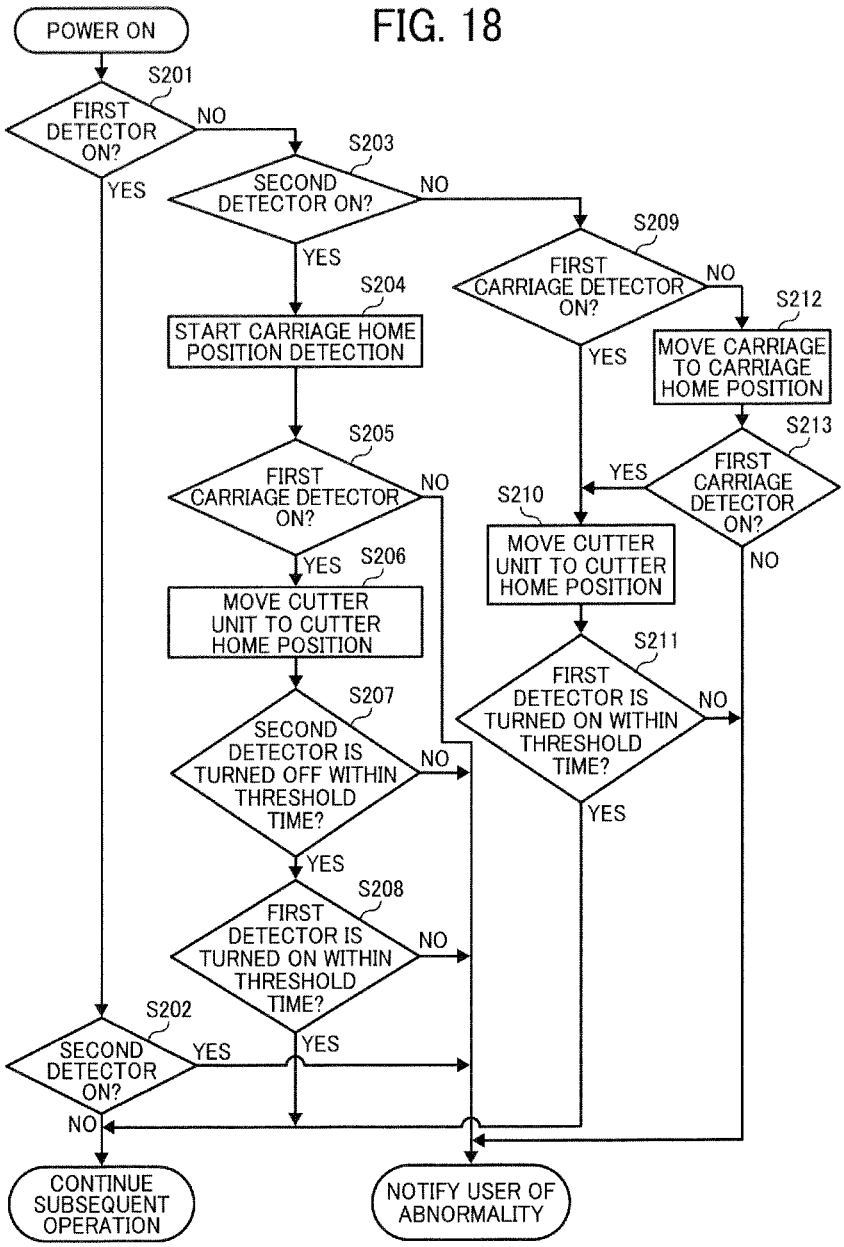
Figure 21:
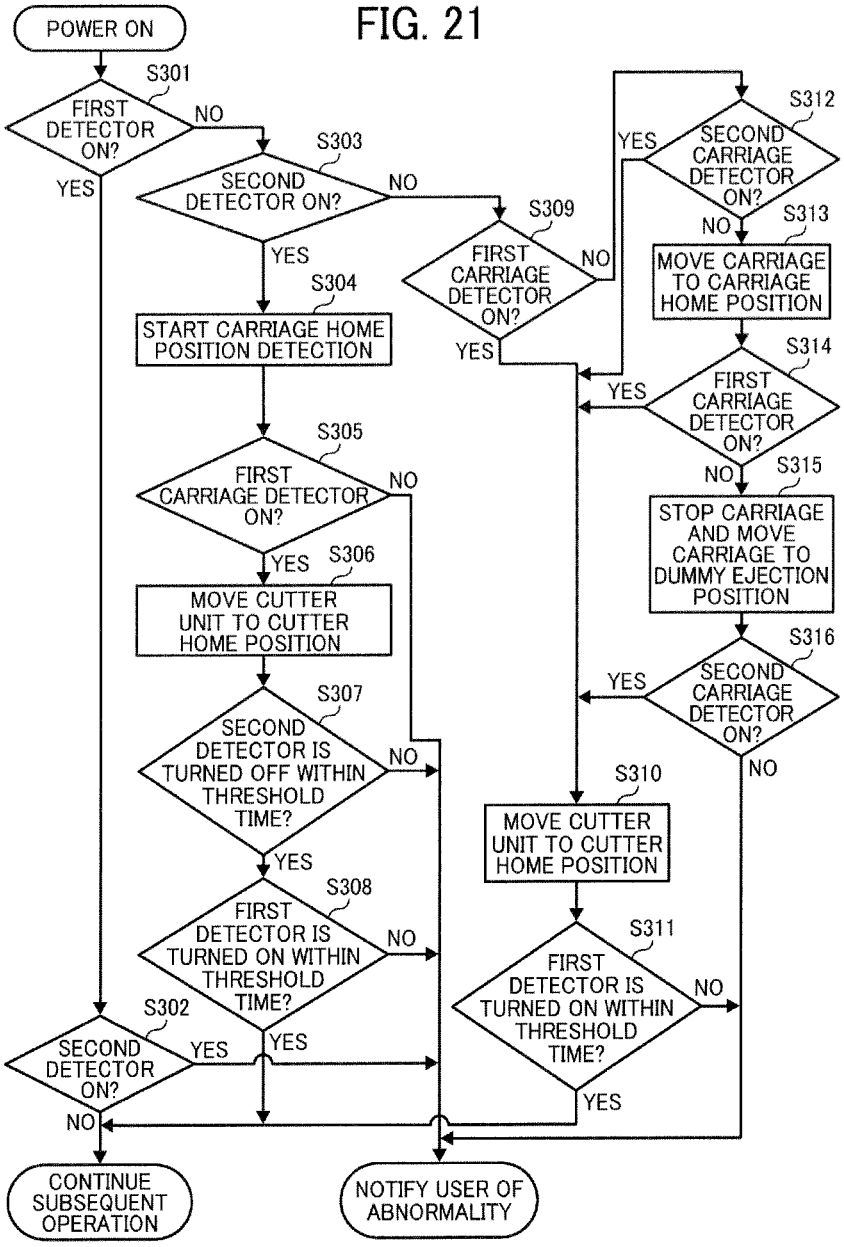

Here, in the process of the cutter initial operation illustrated in FIG. 21, steps S301 to S311 are the same as the steps S201 to S211 of the second exemplary embodiment illustrated in FIG. 18. Therefore, descriptions of the steps S301 to S311 are omitted, and steps differing from those of the second exemplary embodiment are mainly described below.

When the controller 100 determines at S309 that the first carriage detector 111 is not turned on, i.e., is off (NO at S309), at S312 the controller 100 determines whether or not the second carriage detector 112 is turned on. When the controller 100 determines that the second carriage detector 112 is turned on (YES at S312), the controller 100 performs the step S310 and subsequent steps. At this time, since it is confirmed that the carriage 15 is placed at the dummy ejection position, the cutter unit 51 does not contact the cutter unit 15 in cutter initial operation of S310.

By contrast, when the controller 100 determines at S312 that the second carriage detector 112 is not turned on, i.e., is off (NO at S312), the controller 100 cannot specify the position of the carriage 15. Then, at S313, the controller IOU moves the carnage 15 to the carriage home position at a predetermined moving speed. During the movement of the carriage 15, it is detected whether or not the carriage 15 contacts foreign substance, based on information from the ammeter 21*a* or the encoder sensor 103. The predetermined moving speed of S313 is the same as a moving speed at which the carriage 15 is moved in carriage home position detecting operation of S304.

After performing the step S313, at S314 the controller 100 determines whether or not the first carriage detector 111 is turned on. When the controller 100 determines that the first carriage detector 111 is turned on (YES at S314), the controller 100 performs the step S310 and subsequent steps.

By contrast, when the controller 100 determines that the first carnage detector 111 is not turned on, i.e., is off (NO at S314), the controller 100 determines that the carriage 15 is likely to have contacted foreign substance during movement, and immediately notifies a user of abnormality. In such a case, the controller 100 determines that the carriage 15 cannot be further moved toward the carriage home position. At S315, the controller 100 stops movement of the carriage 15 and drives the carriage driving motor 21 so as to perform reverse rotation to move the carriage 15 toward the dummy ejection position.

After the carriage 15 starts to move toward the dummy ejection position, at S316 the controller 100 determines whether or not the second carriage detector 112 is turned on. When the controller 100 determines that the second carriage detector 112 is turned on (YES at S316), the controller 100 determines that the carriage 15 is normally moved to the dummy ejection position and performs the step S310 and subsequent steps.

By contrast, when the controller 100 determines that the second carriage detector 112 is not turned on, i.e., is off (NO at S316), the controller 100 determines that the carriage 15 stops midway of the carriage movement range R1 and immediately notifies a user of abnormality. At this time, it is supposed that foreign substance other than the cutter unit 51, e.g., a sheet is present in the carriage movement range R1. Thus, the notice of abnormality allows the user to remove foreign substance from the carriage movement range R1. In addition, in the above-described situation, the controller 100 cannot specify which the cutter unit 51 is located at the left or h side relative to the carriage 15, thus hampering the cutter initial operation. Hence, after the foreign substance is removed by the user, the controller 100 restarts the process of the cutter initial operation from the first step.

As described above, the inkjet recording apparatus 1 according to the third exemplary embodiment has an effect equivalent to that of each of the first and second exemplary embodiments, and also has the following effect.

That is, the inkjet recording apparatus 1 according to this third exemplary embodiment determines whether or not the carriage 15 is placed at the dummy ejection position as well as the carriage home position. As a result, in a case in which the carriage 15 is placed at the dummy ejection position upon power on of the inkjet recording apparatus 1, the cutter unit 51 does not contact the carriage 15 even if the cutter unit 51 is moved. Thus, the inkjet recording apparatus 1 can perform the cutter initial operation without moving the carriage 15. By contrast, in a case in which the carriage 15 is not placed at the carriage home position and the dummy ejection position upon power on of the inkjet recording apparatus 1, if the cutter initial operation is performed, the cutter unit 51 might contact the carriage 15. Hence, in this exemplary embodiment, after the carriage 15 is moved, the cutter initial operation is performed. Thus, when the power is turned on, the inkjet recording apparatus 1 according to this exemplary embodiment can perform the cutter initial operation while preventing the cutter unit 51 and the carriage 15 from contacting each other.

In addition, when the carriage 15 is not detected with the first carriage detector 111 and the second carriage detector 112 (NO at S309 and S312), the inkjet recording apparatus 1 according to this third exemplary embodiment performs the cutter initial operation after moving the carriage 15 to the carriage home position (S313). Thus, when the carriage 15 might interfere with the cutter unit 51, the inkjet recording apparatus 1 moves the carriage 15 and then performs the cutter initial operation. Such a configuration can perform the cutter initial operation while preventing the carriage 15 from contacting the cutter unit 51.

In each of the above-described exemplary embodiments, the cutter unit 51 has the driving roller 51*a* at the first end side in the sheet width direction and the driven roller 51*b* at the second end side in the sheet width direction. However, the configuration of the cutter unit 51 is not limited to such a configuration, and for example, the positions of the driving roller 51*a* and the driven roller 51*b* are interchangeable. In such a case, the cutter unit 51 pivots in a direction opposite the pivot direction of the cutter unit in each of the above-described exemplary embodiments. Accordingly, the arrangement of the slanted face 51*c* is modified according to the pivoting direction.

In each of the above-described exemplary embodiments, the cutter unit 51 is retracted downward in the vertical direction. Alternatively, for example, in a case in which the sheet cutting device 5 is not horizontally disposed relative to the apparatus main unit 1*a*, the cutter unit 51 may be retracted in the thickness direction of the rolled sheet 30 in accordance with the inclination of the sheet cutting device 5.

Additionally, in each of the above-described exemplary embodiments, the controller 100 controls the carriage driving motor 21 and the cutter-unit driving motor 57. Alternatively, for example, the inkjet recording apparatus may have dedicated controllers to separately control the carriage driving motor 21 and the cutter-unit driving motor 57 and another controller to generally control the dedicated controllers.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject liquid onto a sheet of recording media fed along a sheet feed path;

a carriage mounting the recording head and reciprocally movable in a width direction of the sheet to record an image on the sheet on the sheet feed path with the recording head, the width direction of the sheet perpendicular to a sheet feed direction in which the sheet is fed along the sheet feed path;

a sheet cutting device including a cutter to cut the sheet to a desired length and a cutter unit holding the cutter, the cutter unit movable in the width direction of the sheet, a movement area of the carriage overlapping, in a thickness direction of the sheet, a movement area of the cutter unit in which the cutter unit moves to cut the sheet with the cutter;

a cutter position detecting device to detect a position of the cutter unit; and a controller to perform initial operation upon power on of the image forming apparatus to move the cutter unit to a cutter home position located at one end of opposed ends of the movement area of the cutter unit, wherein the cutter unit, after cutting the sheet with the cutter, is movable in the width direction of the sheet with the cutter unit retracted from the sheet feed path in the thickness direction of the sheet, and the controller determines whether or not to perform the initial operation based on detection results of the cutter position detecting device.

2. The image forming apparatus according to claim 1, further comprising a notification device to notify a user of abnormality of the initial operation, wherein, when the controller determines that the initial operation is not to be performed, the controller causes the notification device to notify a user of abnormality without performing the initial operation.

3. The image forming apparatus according to claim 1, wherein the cutter position detecting device comprises a first detector to detect whether or not the cutter unit is placed at the cutter home position and a second detector to detect whether or not the cutter unit is placed at another end of the opposed ends of the movement area of the cutter unit, the another end being opposite the one end at which the cutter home position is located, and when both the first detector and the second detector detect the cutter unit upon power on of the image forming apparatus, the controller determines that the initial operation is not to be performed.

4. The image forming apparatus according to claim 1, wherein a first standby position and a second standby position are disposed at the opposed ends of the movement area of the cutter unit to prevent the cutter unit from contacting the carriage, and when, upon power on of the image forming apparatus, the carriage is placed at one of the first standby position and the second standby position and the cutter position detecting device detects that the cutter unit is not placed at the cutter home position, the controller performs the initial operation before moving the carriage.

5. The image forming apparatus according to claim 4, further comprising a capping device to cap a nozzle face of the recording head at a capping position, wherein the capping position is located on same side as the cutter home position with respect to the first standby position and the second standby position of the carriage, the capping device caps the nozzle face before cutting of the sheet, and when the cutter position detecting device detects upon power on of the image forming apparatus that the cutter unit is not placed at the cutter home position, the controller performs the initial operation before moving the carriage.

6. The image forming apparatus according to claim 4, further comprising a carriage position detecting device to detect that the carriage is placed at the first standby position or the second standby position, wherein, when the carriage position detecting device detects upon power on of the image forming apparatus that the cutter unit is not placed at the cutter home position, the controller determines whether or not to move the carriage before performing the initial operation based on detection results of the carriage position detecting device.

7. The image forming apparatus according to claim 6, wherein, when the carriage position detecting device detects the carriage upon power on of the image forming apparatus, the controller performs the initial operation.

8. The image forming apparatus according to claim 6, further comprising a capping device to cap a nozzle face of the recording head at a capping position located on same side as the cutter home position with respect to the first standby position and the second standby position of the carriage, wherein the carriage position detecting device includes a first cam detector to detect that the carriage is placed at the capping position.

9. The image forming apparatus according to claim 8, wherein the recording head performs dummy ejection at a dummy ejection position to maintain and recover ejection performance of the recording head, the dummy ejection position is located at a side opposite the capping position with respect to the first standby position and the second standby position, and the carriage position detecting device includes the first carriage detector and a second carriage detector to detect that the carriage is placed at the dummy ejection position.

10. The image forming apparatus according to claim 6, wherein, when the carriage position detecting device does not detect the carriage, the controller moves the carriage to one of the first standby position and the second standby position and performs the initial operation.

* * * * *